US012050010B2

(12) United States Patent
Sutherland et al.

(10) Patent No.: US 12,050,010 B2
(45) Date of Patent: Jul. 30, 2024

(54) LOW-PRESSURE GAS BURNER

(71) Applicant: Questor Technology Inc., Calgary (CA)

(72) Inventors: John Joseph Sutherland, Calgary (CA); Justin Edward Bouchard, Calgary (CA); Jeffrey David Nelson, Calgary (CA)

( * ) Notice: Subject to any disclaimer, the term of this patent is extended or adjusted under 35 U.S.C. 154(b) by 309 days.

(21) Appl. No.: 17/309,123

(22) PCT Filed: Oct. 2, 2019

(86) PCT No.: PCT/CA2019/051413
§ 371 (c)(1),
(2) Date: Apr. 27, 2021

(87) PCT Pub. No.: WO2020/087154
PCT Pub. Date: May 7, 2020

(65) Prior Publication Data

US 2022/0003413 A1 Jan. 6, 2022

Related U.S. Application Data

(60) Provisional application No. 62/782,869, filed on Dec. 20, 2018, provisional application No. 62/782,990, (Continued)

(30) Foreign Application Priority Data

Dec. 20, 2018 (CA) ..... CA 3028398

(51) Int. Cl.
*F23D 14/02* (2006.01)
*F23D 14/48* (2006.01)
(Continued)

(52) U.S. Cl.
CPC ..... *F23G 7/085* (2013.01); *F23D 14/02* (2013.01); *F23D 14/48* (2013.01); *F23D 14/62* (2013.01);
(Continued)

(58) Field of Classification Search
CPC ..... F23G 7/085; F23G 2209/14; F23D 14/02; F23D 14/48; F23D 14/62; F23D 23/00; F23D 2212/20; F23D 2900/14641
(Continued)

(56) References Cited

U.S. PATENT DOCUMENTS

2003/0175636 A1* 9/2003 Stephens ..... F23L 7/005 431/9
2004/0248055 A1* 12/2004 Mashhour ..... F23G 7/065 431/202
(Continued)

FOREIGN PATENT DOCUMENTS

CN 104764010 A * 7/2015

*Primary Examiner* — Avinash A Savani
(74) *Attorney, Agent, or Firm* — Richard D. Okimaw

(57) ABSTRACT

A burner for combusting low pressure gas includes: an outer wall configured as a venturi including a lower end, a mid throat section, and an upper end, the lower end being bell shaped and the upper end further including an upper end inner diameter; and a nozzle configured to receive and deliver a low-pressure gas stream, the nozzle having an opening into the lower end.

20 Claims, 7 Drawing Sheets

Related U.S. Application Data filed on Dec. 20, 2018, provisional application No. 62/752,869, filed on Oct. 30, 2018.

(51) Int. Cl.
*F23D 14/62* (2006.01)
*F23D 23/00* (2006.01)
*F23G 7/08* (2006.01)

(52) U.S. Cl.
CPC ..... *F23D 23/00* (2013.01); *F23D 2212/20* (2013.01); *F23D 2900/14641* (2013.01); *F23G 2209/14* (2013.01)

(58) Field of Classification Search
USPC ..... 431/202
See application file for complete search history.

(56) References Cited

U.S. PATENT DOCUMENTS

| | | | | |
|---|---|---|---|---|
| 2005/0053887 | A1* | 3/2005 | Westergaard | F23D 14/62 431/354 |
| 2011/0027732 | A1* | 2/2011 | Schiessel | F23R 3/286 431/190 |
| 2015/0354815 | A1* | 12/2015 | Bacon | F23G 7/085 431/5 |
| 2016/0025336 | A1* | 1/2016 | Lang | F23G 7/085 431/354 |
| 2016/0107914 | A1* | 4/2016 | Baker | F23D 14/22 431/355 |

* cited by examiner

LOW-PRESSURE GAS BURNER

FIELD OF THE INVENTION

This invention relates to a burner adapted to be used on gas flare stacks and the like.

BACKGROUND

Historically, industry directed low-pressure waste gases to low-pressure flares or vent stacks. Vent stacks release untreated waste gases into the environment. Low-pressure flares expose waste gases to an uncontained flame, allowing much of the waste gas to escape into the environment.

In order to prevent waste gases from polluting the environment, a pipe is often connected to the container or tank containing the waste gases to divert the gases to a combustion device. Historically, this has required compressing waste gas to allow for combustion in a conventional burner.

Low pressure gas, such as of 15 psig or less, which is often times 5 psig or less, is difficult to combust in a conventional burner. Compressing gas to achieve a higher pressure is time consuming and expensive.

There is a commercial demand for a way to combust low-pressure gases without compressing the gas.

SUMMARY

In accordance with a broad aspect of the present invention, there is provided a burner, comprising: an outer wall configured as a venturi including a lower end, a mid throat section, and an upper end, the lower end being bell shaped and the upper end further including an upper end inner diameter; and a nozzle configured to receive and deliver a low-pressure gas stream, the nozzle having an opening into the lower end.

In accordance with another broad aspect of the present invention, there is provided an incinerator comprising: a body; an air intake at a lower section of the body configured to allow air to enter the body; at least one burner, within the body in communication with and situated above the air intake, the at least one burner including: an outer wall configured as a venturi including a lower end, a mid throat section, and an upper end, the lower end being bell shaped and the upper end further including an upper end inner diameter; and a nozzle configured to receive and deliver a low-pressure gas stream, the nozzle having an opening into the lower end; a combustion area within the body in communication with and situated above the at least one burner; and a stack area of the body, in communication with and situated above the combustion section; the incinerator being configured to achieve high combustion efficiency of a low-pressure waste gas stream It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DESCRIPTION OF VARIOUS EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

The invention provides a burner configured to combust low-pressure gases into substantially smokeless combustion products. The low-pressure gases can be combusted as is, without requiring them to be compressed.

Figure 1:
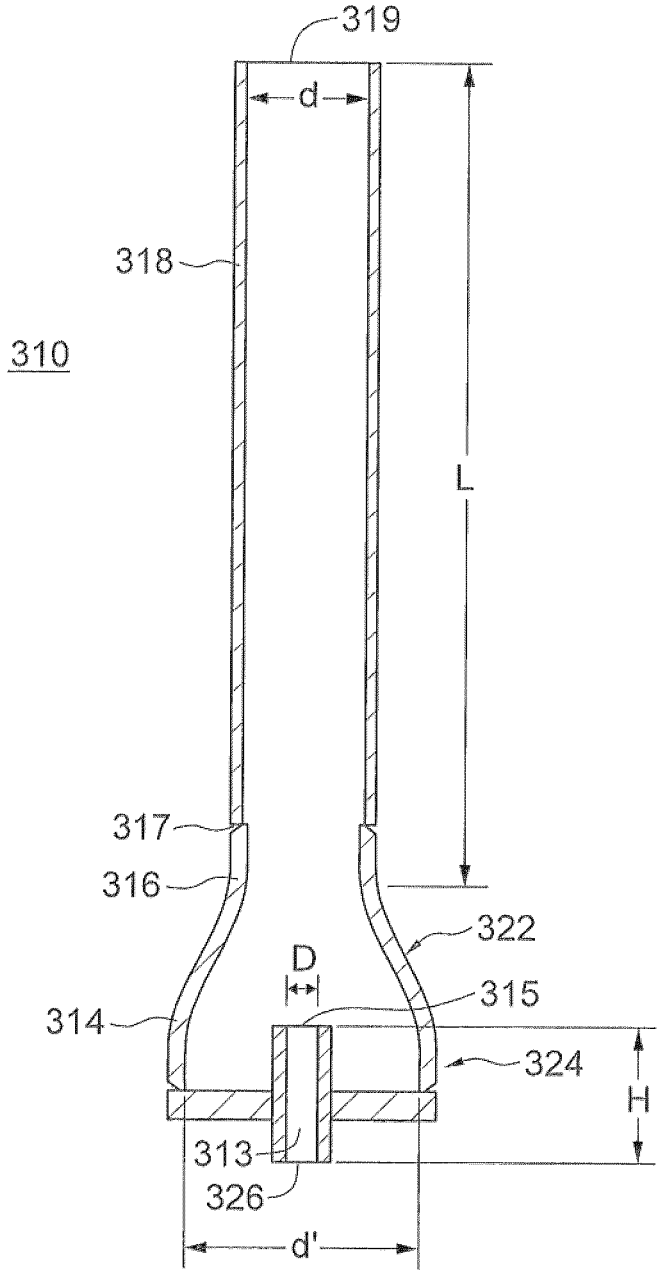
FIG. 1 is a cross section view of a burner.
Figure 2:
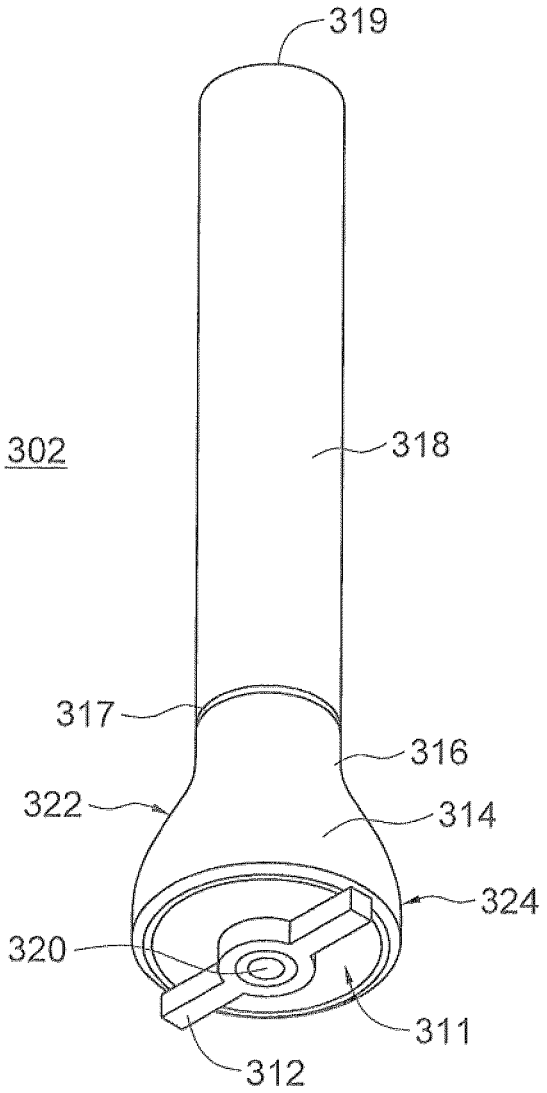
FIG. 2 is a bottom perspective view of an outer wall of a burner.

With reference to FIGS. 1 and 2, a burner 302 includes an outer wall 310 and a nozzle 313. The outer wall is configured as a venturi, including a lower end 314, a mid throat section 316, and an upper end 318.

Nozzle 313 is configured to receive and deliver a low-pressure gas stream. The nozzle has an opening 315 in communication with the lower end of the outer wall. The nozzle may terminate in the lower end. The nozzle has a diameter D.

The upper end of outer wall 310 has length L, extending from an open tip 319 to the upper limit of mid throat section, indicated in FIG. 1 at the point of reference number 316. The upper limit of the mid throat section is where the taper of the mid throat section stops. A major portion of the upper end of outer wall 310 may have a substantially constant inner diameter d along its length L. In other words, the upper end may be cylindrical and the upper end diameter d substantially doesn't flare (increase) or taper (decrease) towards the tip. The substantially constant diameter along most or all of the upper end from at or near throat 316 to tip 319 promotes mixing of the gas with oxygen, but also maintains the pressure and concentration of the gas.

The upper end may further include an upper end length to upper end inner diameter ratio L:d within the range of 12:1 and 14:1. During development of the invention, it was observed that the ratios described herein, including ratio L:d and other ratios described below, yielded improved combustion efficiency over constructions outside the ratio ranges.

The flame patterns known to result in high combustion efficiency occurred within the ranges indicated. The measured combustion efficiency was high and with no visible black smoke exiting the incinerator within which the burners were operating.

The lower end is bell shaped and, as such, has a larger diameter at its mouth 311 than at the mid throat section. The lower end may have a tapering section 322 and a wall 324 defining the mouth.

The lower end's mouth has a mouth inner diameter d'. The mid throat section's diameter is substantially the same as diameter d. A mouth inner diameter to upper end inner diameter ratio d':d may be within the range of 1.6:1 and 2:1. Burners configured within this range were found to operate with high combustion efficiency. In particular, the measured combustion efficiency was high, with no visible black smoke observed passing out of the incinerator.

Wall 324 at mouth has a variable shape. That is, wall 324 may have a substantially constant diameter d', as illustrated in FIGS. 1 and 2. Alternately, wall 324 may flare adjacent the mouth. That is, the lower end's diameter may continuously increase, beginning where the mid throat section transitions to the lower end, and terminating at the mouth. In the illustrated embodiment, wall 324 has a length where the diameter is substantially consistent and then the lower end tapers toward the throat.

Figure 3:
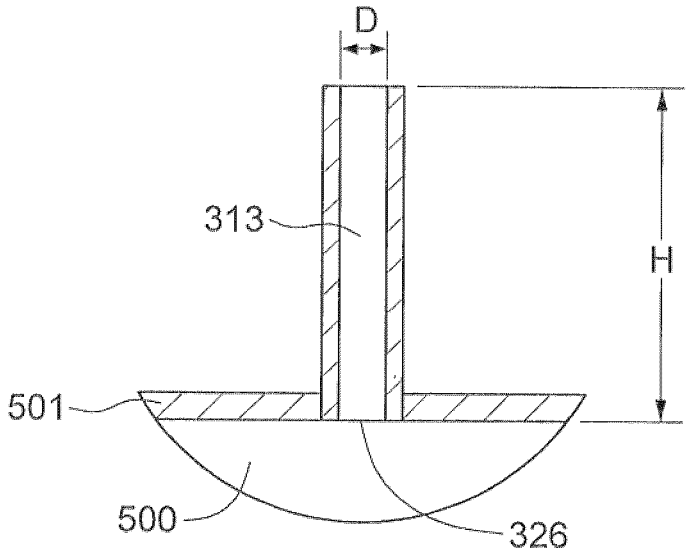
FIG. 3 is a cross section view of a nozzle mounted on a partly cutaway plenum chamber.

With reference to FIG. 3, nozzle 313 for the low pressure burner is often installed on a manifold 500. In such an embodiment, the nozzles are installed on a manifold wall 501, such as by threading or welding into ports on the manifold wall.

The nozzle may have a substantially consistent inner diameter D along its length. The nozzle may include a nozzle height H measured from its inboard, receiving end 326 to the nozzle's opening 315. In one embodiment, the nozzle has a nozzle height to inner nozzle diameter ratio H:D within the range of 7:1 to 9:1.

During testing with a nozzle configured such that the ratio H:D is within the range of 7:1 to 9:1, it was found that gas even at low pressures of 5 psig or less and in unprocessed conditions, such as not completely dehydrated, flowed reliably through the nozzle. The nozzle with this configuration offers a desirable velocity profile with low pressure gas and acts like a capillary to draw gas along it. However, at the same time condensation, if it does occur, tends not to occlude the inner diameter. Also, the burner with this nozzle construction produced a flame with high combustion efficiency based on analysis of the resulting combustion products.

The nozzle's receiving end 326 is where the nozzle receives gas and the nozzle's opening 315 is where the nozzle delivers gas into the outer wall's lower end 324. The opening may be positioned with various degrees of penetration into the lower end 314, including right at the mouth of the outer wall. In other words, the nozzle's opening 315 may be in substantially the same plane as the lower limit of the outer wall or the opening 315 may protrude further into the lower end 314 towards throat 316. In one embodiment, opening 315 extends into the lower end but is positioned at the transition where wall 324 begins to taper toward throat. In particular, opening 315 may be positioned at about the depth where diameter of lower end 314 begins to taper.

With reference to FIG. 2, the lower end may be connectable to the nozzle, for example by way of a cross piece 312. The nozzle and the cross piece may be connected by threading, including engagement between a thread on nozzle and a threaded opening 320 on the cross piece. Such threading allows an operator to replace a damaged outer wall, or substitute the outer wall for another outer wall selected for different conditions or gases.

The lower end and the mid throat section may have a smoother surface relative to the inner surface of the upper end. In one embodiment, the lower end and mid throat section may be treated in a first manner or have a first material selection, and the upper end treated in a second manner or have a second material selection, such that the lower end and mid throat section are smoother, and therefore have a lower Reynold's Number, relative to the upper end. Such treatments may include polishing, coating or sanding the inner facing surfaces of lower end 314 and mid throat section 316. For example, the inner surfaces of lower end 314 and throat section 316 may be polished while the inner surface of upper end 318 is not polished and therefore is rougher than the lower end and the throat. The relatively rougher inner surface may be between the throat 316 and tip 319 but in the illustrated embodiment the relatively rougher inner surface extends between tip 319 and a point, such as point 317, spaced a small distance from the throat.

In one embodiment, the outer wall of the burner may have a multipart construction for example where an upper end portion 318 is secured as by threading or welding to the throat 316. This construction facilitates the selection of different surface roughness noted above. This construction may create an annular seam on the inner surface of upper end, illustrated at point 317. While the seam may be substantially flush, it may create a discontinuity such as the illustrated step in FIG. 1, which is close to the throat in the upper end. This step may be close to where the mid throat section transitions into the upper end. Since it is desirable to maintain the diameter d of the upper end substantially constant without flaring or tapering, any discontinuity should be small such that the diameter does not vary much across point 317. Regardless, after the annular discontinuity, if any, the diameter d of a major portion of the upper end from point 317 to the tip remains substantially constant without flaring or tapering.

The burner may be constructed of stainless steel, thereby protecting against damage by corrosive gases and high temperatures encountered during combustion.

Figure 4:
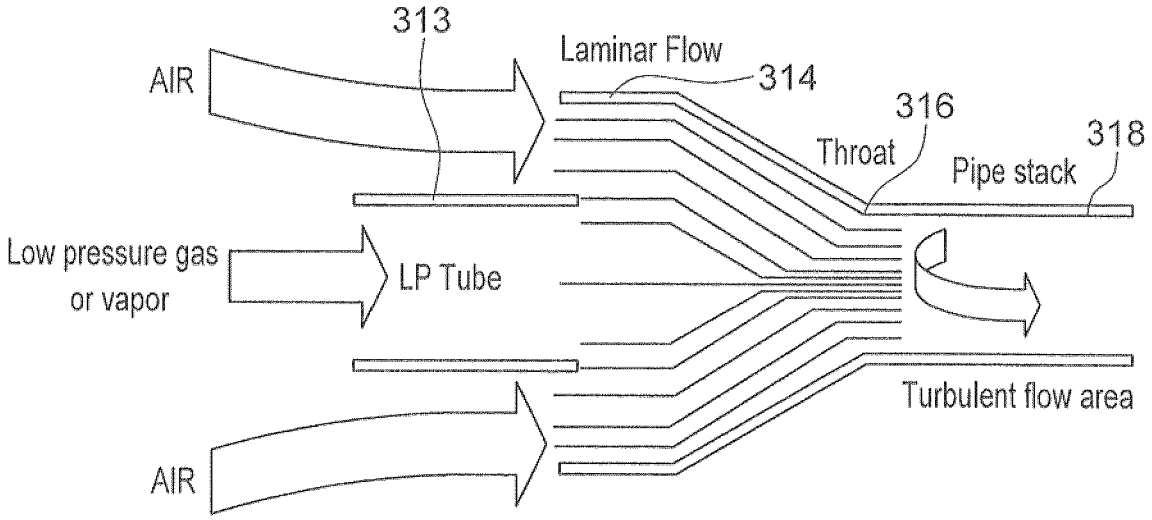
FIG. 4 is a diagram illustrating flow of fluid through a burner in operation.

With reference to FIG. 4, outer wall 314 including the lower end and the mid throat section act as a venturi to draw air into the lower end. This allows air to mix with gas from the low-pressure gas stream, thereby: creating a fluid mixture of gas and air, increasing the velocity, and decreasing the pressure of the fluid passing through the upper end of the burner, and directing the fluid mixture up through the throat and out of the tip. The fluid mixture is ignited after it exits the tip 319 of the upper end.

The smooth interior of the lower end and mid throat section reduces turbulence, thereby facilitating laminar flow and increasing velocity, of fluid passing therethrough. The rough interior of the upper end, has a higher Reynolds Number than the lower end and mid throat, increases turbulence, thereby promoting mixing, of fluid passing therethrough; and causing the flame to burn at an ideal height above the tip.

If there is a discontinuity such as a step at point 317, an eddy is created, thereby further slowing the velocity and mixing the fluid.

Gases at low pressure are challenging to combust efficiently. Higher calorific values makes it difficult to induce sufficient oxygen. Lower calorific value gases may require fuel to supplement the combustion process. Where the low-pressure waste gas stream may have a low hydrocarbon content, the nozzle may be in communication with an additional fuel supply. Additional fuel facilitates combustion of low-pressure waste gas that has a low hydrocarbon content.

Figure 5:
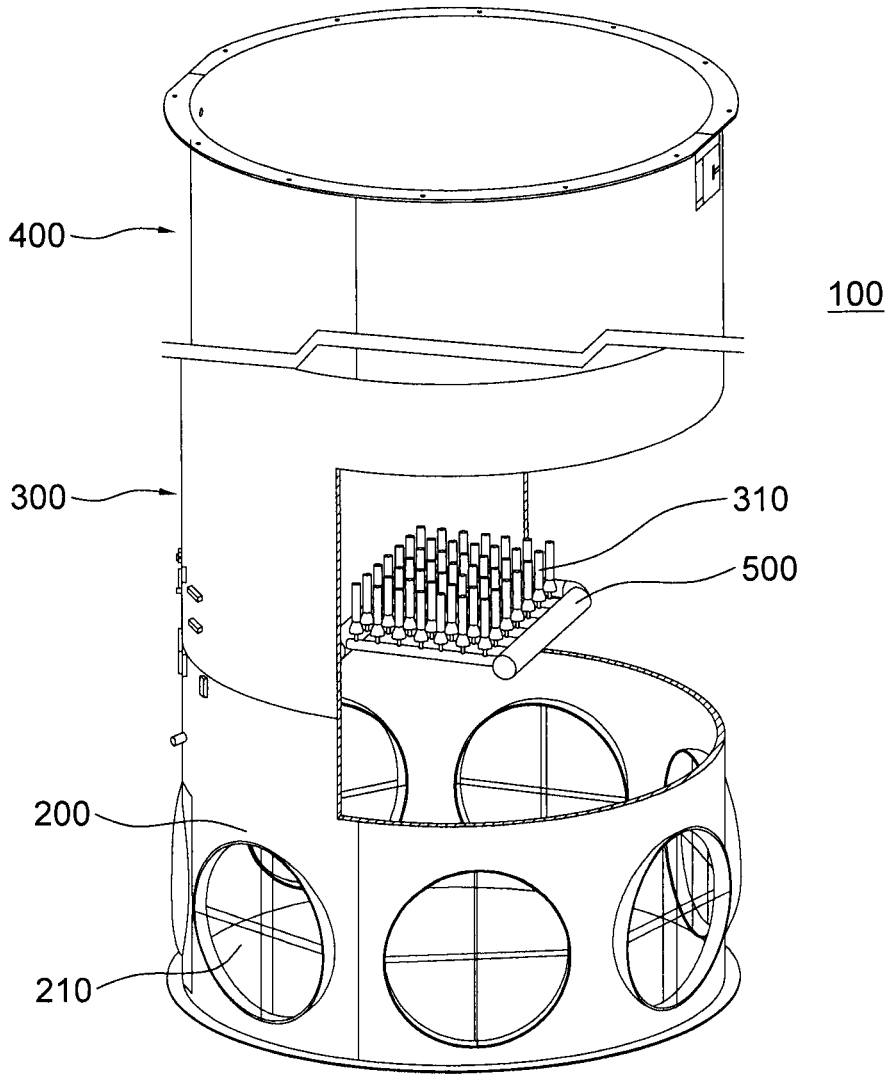
FIG. 5 is a perspective view of an incinerator wherein the burners are arranged on a first manifold in the shape of a ring, and a second manifold connected to and surrounded by the first manifold, the burners of the second manifold being arranged in a grid.

With reference to FIG. 5, an incinerator may be configured with the above described burner to achieve high combustion efficiency of a low-pressure waste gas stream. In one embodiment, the incinerator comprises a body 100, including a lower section 200, a combustion area 300 above the lower section, and a stack area 400 above the combustion area. The body may be formed as an upwardly extending cylinder. The pressure of the low-pressure waste gas stream may be between 0.1 and 15 psig, or less than 5 psig such as between 1 and 3 ounces/int.

The lower section includes an air intake 210 to allow air to enter the body.

The combustion area within the body is in communication with at least one burner, for example, one of the burner embodiments described above. The combustion area is configured to allow hydrocarbons in the low-pressure waste gas stream to burn in the presence of oxygen to reduce hydrocarbons into substantially smokeless combustion byproducts. Such by-products may include carbon dioxide, water vapor and thermal energy.

The combustion area may further include a manifold 500 with the at least one burner installed thereon. With reference to FIG. 3, the nozzle may be connected to the manifold, for example by threading, with receiving end 326 in communication with the manifold internal chamber. The burner, including the height H of the nozzle and the length L of the outer wall may extend vertically upwardly from the manifold, parallel with the long axis from lower section 200 and up through stack 400.

Figure 6:
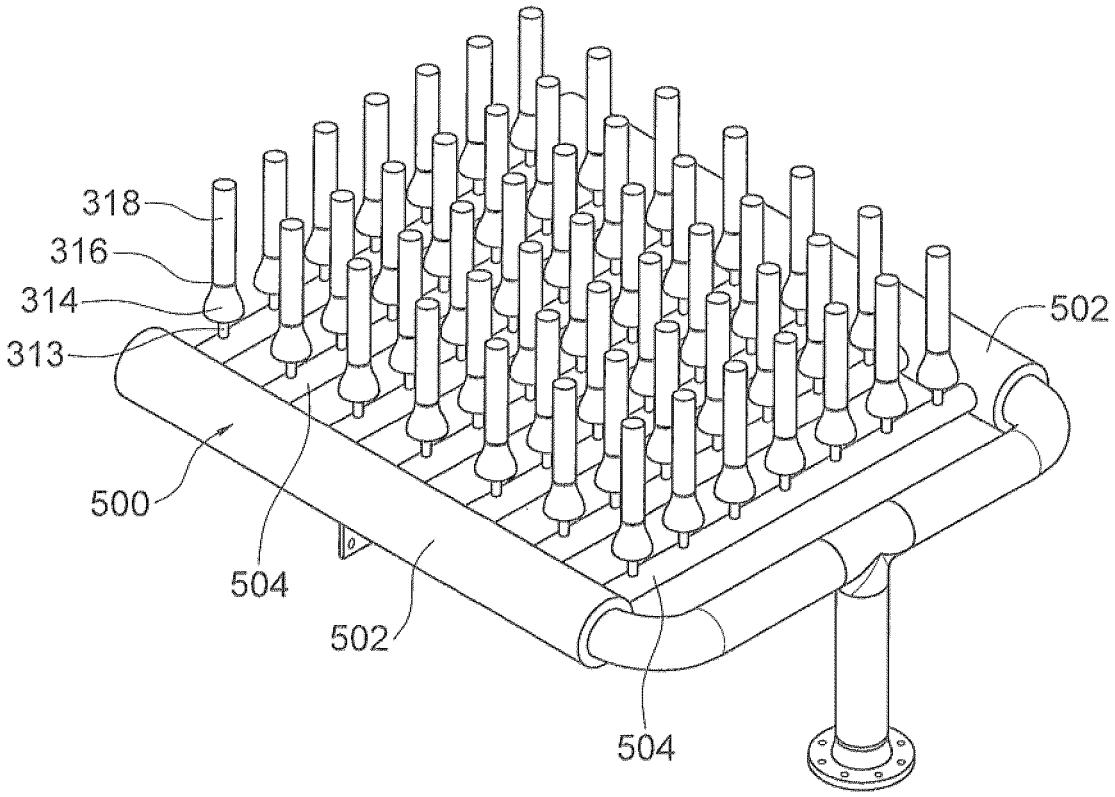
FIG. 6 is a top perspective view of a plurality of burners arranged on a manifold.
Figure 7:
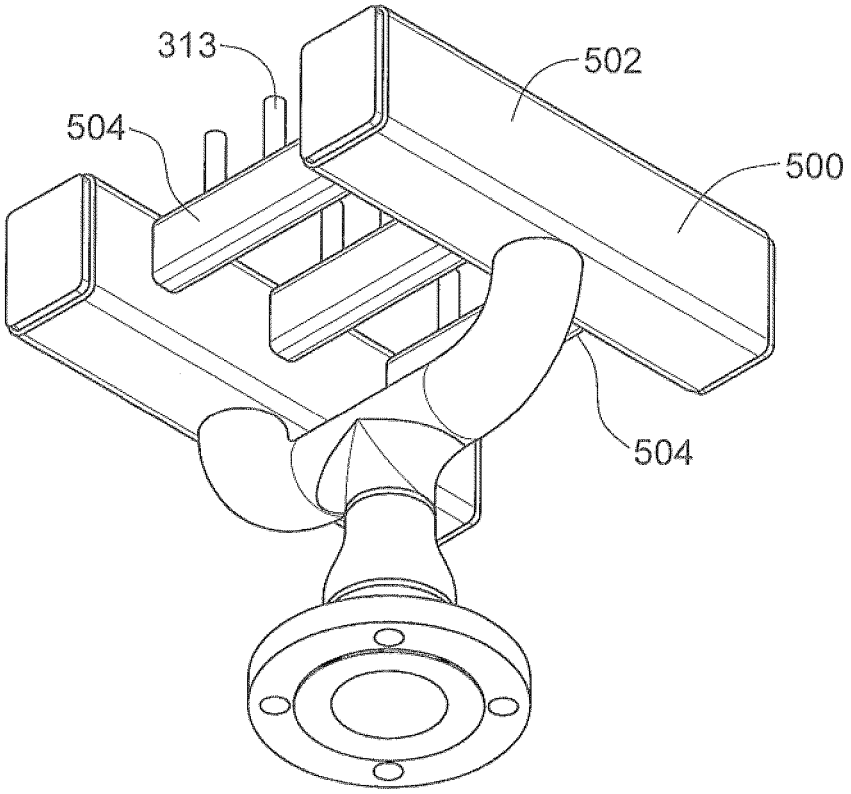
FIG. 7 is a bottom perspective view of a manifold with a plurality of nozzles connected thereto.

With reference to FIG. 6, the manifold may be configured as a ladder, including two side members 502 and at least one cross member 504 extending therebetween. In the illustrated embodiment, there is a plurality of cross members. The burners may be arranged on the manifold in a grid pattern. The burners may be arranged such that the burners are substantially evenly spaced apart. In such an embodiment, with reference to FIG. 7, the manifold acts as a plenum chamber, thereby providing each burner a substantially similar volume of gas, even as the low-pressure waste gas stream surges and wanes.

The stack area is in communication with and situated above the combustion section, and is configured to provide additional room, and thereby residence time, for hydrocarbons to reduce into substantially smokeless combustion byproducts.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

We claim:

1. A burner comprising an outer wall configured as a venturi including a lower end, a mid throat section, and an upper end, wherein:

the lower end being bell shaped; and the outer wall having a height from the lower end to the upper end and an inner diameter, the inner diameter of the outer wall including an upper end inner diameter within the upper end, wherein the upper end inner diameter of the outer wall is substantially constant along at least a major portion of the height above the lower end; and the upper end has a rough inner surface that is rough relative to the inner surface of the lower end and the mid throat section; and a nozzle configured to receive and deliver a low-pressure gas stream, the nozzle having an opening into the lower end below the throat section such that the low pressure gas stream exiting the nozzle and air passing through the venturi pass through the mid throat section together.

2. The burner of claim 1, wherein the nozzle further includes an inner nozzle diameter, a nozzle height, and a nozzle height to inner nozzle diameter ratio within the range of 7:1 to 9:1.

3. The burner of claim 1, wherein the upper end further includes an upper end length, and an upper end length to upper end inner diameter ratio within the range of 12:1 and 14:1.

4. The burner of claim 1, wherein the lower end further includes a mouth inner diameter and a mouth inner diameter to upper end inner diameter ratio within the range of 1.6:1 and 2:1.

5. The burner of claim 1, wherein the lower end has a tapering section and a mouth wall, the mouth wall having a substantially constant diameter.

6. The burner of claim 5, wherein the opening terminates laterally inwardly of the mouth section wall.

7. The burner of claim 1, wherein the nozzle is threadably connected to the lower end.

8. The burner of claim 1, wherein the lower end further comprises a cross piece configured to connect to the nozzle.

9. The burner of claim 1, wherein the burner is constructed of stainless steel, thereby protecting against corrosive gases and high temperatures encountered during combustion.

10. An incinerator comprising:

a body;

an air intake at a lower section of the body configured to allow air to enter the body;

at least one burner, within the body in communication with and situated above the air intake, the at least one burner including: an outer wall configured as a venturi including a lower end, a mid throat section, and an upper end, wherein:

the lower end being bell shaped;

the outer wall having a height from the lower end to the upper end and an inner diameter, the inner diameter of the outer wall including an upper end inner diameter within the upper end, wherein the upper end inner diameter of the outer wall is substantially constant along at least a major portion of the height above the lower end; and the upper end has a rough inner surface that is rough relative to the inner surface of the lower end and the mid throat section; and a nozzle configured to receive and deliver a low-pressure gas stream, the nozzle having an opening into the lower end below the throat section such that the low pressure gas stream exiting the nozzle and air passing through the venturi pass through the mid throat section together;

a combustion area within the body in communication with and situated above the at least one burner; and a stack area of the body, in communication with and situated above the combustion section;

the incinerator being configured to achieve high combustion efficiency of a low-pressure waste gas stream.

11. The incinerator of claim 10, further comprising a manifold, configured as a ladder, including two side members and at least one cross member extending therebetween;

the at least one burner being a plurality of burners, and the plurality of burners being arranged on the manifold in a grid pattern; and the manifold acting as a plenum chamber thereby providing each burner a substantially similar volume of gas.

12. The incinerator of claim 10, wherein the low-pressure waste gas stream has a pressure between 0.1 and 15 psig.

13. The incinerator of claim 10, wherein the low-pressure waste gas stream has a pressure between 1 and 3 ounces/int.

14. The incinerator of claim 10, wherein the low-pressure waste gas stream has a low hydrocarbon content;

the incinerator further comprises a fuel supply in communication with the combustion area, the fuel supply supplying fuel and thereby facilitating combustion of the low-pressure waste gas stream.

15. The incinerator of claim 10, wherein the nozzle further includes an inner nozzle diameter, a nozzle height, and a nozzle height to inner nozzle diameter ratio within the range of 7:1 to 9:1.

16. The incinerator of claim 10, wherein the upper end further includes an upper end length, and an upper end length to upper end inner diameter ratio within the range of 12:1 and 14:1.

17. The incinerator of claim 10, wherein the lower end further includes a mouth inner diameter and a mouth inner diameter to upper end inner diameter ratio within the range of 1.6:1 and 2:1.

18. The incinerator of claim 10, wherein the lower end has a tapering section and a wall defining a lower open mouth of the lower end, the wall having a substantially constant diameter.

19. The incinerator of claim 18, wherein the opening of the nozzle is positioned in the lower end at a position in a plane where the wall has a substantially constant diameter.

20. The incinerator of claim 18, wherein the opening of the nozzle extends into the lower end and is position at the depth where the wall transitions to the tapering section.

* * * * *